US005486119A

United States Patent [19]

Nabeshima et al.

[11] Patent Number: 5,486,119

[45] Date of Patent: Jan. 23, 1996

[54] MATABLE CONNECTOR

[75] Inventors: Akira Nabeshima; Kaoru Watanabe; Toshikazu Saba, all of Yokkaichi, Japan

[73] Assignee: Sumitomo Wiring Systems, Ltd., Mie, Japan

[21] Appl. No.: 198,282

[22] Filed: Feb. 18, 1994

[30] Foreign Application Priority Data

| | | | |
|---|---|---|---|
| Mar. 19, 1993 | [JP] | Japan | 5-018644 U |
| Mar. 19, 1993 | [JP] | Japan | 5-018645 U |
| Mar. 19, 1993 | [JP] | Japan | 5-018646 U |

[51] Int. Cl.[6] ..... H01R 3/00

[52] U.S. Cl. ..... 439/489; 439/364

[58] Field of Search ..... 439/359, 362, 439/364, 488, 489

[56] References Cited

U.S. PATENT DOCUMENTS

| | | | |
|---|---|---|---|
| 4,015,888 | 4/1977 | Draper et al. | 439/489 X |
| 4,629,351 | 12/1986 | Kato et al. | 439/488 X |
| 4,907,118 | 3/1990 | Hames . | |
| 5,192,225 | 3/1993 | Suzuki . | |
| 5,228,867 | 7/1993 | Nagamine | 439/489 X |
| 5,336,104 | 8/1994 | Nagamine | 439/489 X |

FOREIGN PATENT DOCUMENTS

| | | |
|---|---|---|
| 0448083A1 | 3/1990 | European Pat. Off. . |
| 2580434 | 4/1985 | France . |
| 63-132383 | 1/1988 | Japan . |

*Primary Examiner*—Khiem Nguyen
*Attorney, Agent, or Firm*—Oliff & Berridge

[57] ABSTRACT

A bolt provided on a female connector housing is tightened relative to a nut, provided on a male connector housing, displacing the two connector housings relative to each other in a connecting direction, thereby fitting them together. An upwardly-extending, bar-like projection portion is provided on the male connector housing. A detection member is provided in an insertion hole formed in the female connector housing. When the two connector housings are displaced relative to each other in the connecting direction, the projection pin and the detection member cooperate to indicate a fitting-completed condition, enabling easily perceived completion of the connection. Alternatively, the male and female connector housings include electrically engageable sensing elements that indicate the fitting-completed condition.

7 Claims, 12 Drawing Sheets

MATABLE CONNECTOR

BACKGROUND OF THE INVENTION

This invention relates to a connector in which two connector housings are fitted together, and more particularly to a connector in which a fitting-completed condition of the two connector housings can be detected by a fitting indicator such as a detection pin or electrical detector.

In connectors, and particularly the type of connector having many terminals, the force for fitting male and female connector housings is large, so that a large force is required for attaching and detaching them. To deal with this, there has been proposed a so-called screw tightening-type connector. In this construction, a bolt is rotatably mounted, for example, on a female connector housing, and a nut is mounted on a male connector housing. The bolt is tightened relative to the nut, thereby fitting the two connector housings together.

Incidentally, the bolt tightening operation is carried out using a tool such as an impact wrench. If the bolt is tightened excessively, the bolt may be broken, or the housing may be damaged. Therefore, in recent years, there has been proposed a construction in which a threaded portion of a bolt is provided partially on a distal end portion of a bolt shaft, and in a fitting-completed condition of two connector housings, the threaded portion of the bolt extends forwardly from the nut, thereby freely rotating without engagement with the nut. This prevents excessive tightening of the bolt (for example, Japanese Patent Unexamined Publication No. 63-13283).

However, in the above construction in which the bolt freely rotates in the fitting-completed condition of the two connector housings, an excessive tightening of the bolt is eliminated, but in a tightening operation by an impact wrench, the operator cannot clearly perceive the degree of tightening of the bolt. Accordingly, the operator may stop the tightening operation before the fitting-completed condition of the two connector housings is achieved, that is, in a so-called half-fitted condition.

SUMMARY OF THE INVENTION

The present invention has been made under the above circumstances, and an object of the invention is to provide a connector in which a fitted condition of two connector housings can be easily perceived.

In order to achieve the above object, the present invention provides a connector wherein a bolt is provided on one connector housing and a nut is provided on the other connector housing. By tightening the bolt relative to the nut, the two connector housings are displaced relative to each other in a connecting direction and fitted together. An indicator is provided on the connector housing, the indicator being displaced in accordance with the displacement of the two connector housings in the connection direction to indicate a fitting-completed condition of the two connector housing.

In the connector of the present invention having this construction, when the bolt is tightened relative to the nut, the indicator is displaced in accordance with the displacement of the two connector housings in the connecting direction and indicates the fitting-completed condition of the two connector housings. Therefore, by viewing the indicator, the operator can readily know the fitting-completed condition of the two connector housings. Therefore, the operator effects the bolt tightening operation while viewing the indicator, and by doing so, the bolt tightening operation can be stopped in a suitable condition in which the tightening of the bolt is not excessive or insufficient.

A second embodiment achieves the above object by the provision of a pin insertion hole formed in one connector housing, the hole having opposite open ends; a fitting detection pin having a resilient, inwardly-deformable insertion piece at a distal end thereof, insertable into the pin insertion hole from one end of the pin insertion hole; and a projection portion formed on the other connector housing, insertable into the pin insertion hole from the other end thereof in accordance with the displacement of the two connector housings in a connecting direction. The projection portion retains the fitting detection pin at a distal end thereof to urge the pin toward the one end of the pin insertion hole. When the fitting detection pin is urged by the projection portion, the insertion piece is gradually, resiliently deformed inward. In a fitting-uncompleted condition of the two connector housings, the fitting detection pin is prevented (by retainment by the projection portion) from being further inserted, and in a fitting-completed condition of the two connector housings, the amount of deformation of the insertion piece is large so that the retainment thereof by the projection portion is released. Therefore, the fitting detection pin can be inserted to a position beyond the distal end of the projection portion.

In order to achieve the above object, the present invention according to a fourth embodiment provides a pressing portion provided on the one connector housing; a pressure sensitive element provided on the other connecting housing and pressed by the pressing portion in a fitting-completed condition of the two connector housings; and fitting detection connection terminals provided on the other connector housing for outputting a signal from the pressure sensitive element.

The present invention according to a fifth embodiment provides a pair of conductors provided on the connector housing and electrically connected together in a fitting-completed condition of the two connector housings; and fitting detection connection terminals provided on the connector housing for detecting whether or not electrical connection between the conductors is made.

In the first connector of the present invention having the above construction, in the fitting-completed condition of the two connector housings, the pressing portion provided on the one connector housing presses the pressure sensitive element provided on the other connector housing, so that the output of the pressure sensitive element is changed. Therefore, by connecting a detection circuit to the fitting detection connection terminals to output a signal from the pressure sensitive element, the fitting-completed condition can be detected.

In the second connector of the present invention, in the fitting-completed condition of the two connector housings, the pair of conductors provided on the connector housing are electrically connected together. Therefore, by connecting the detection circuit to the fitting detection connection terminals, the fitting-completed condition of the two connector housings can be detected.

BRIEF DESCRIPTION OF THE DRAWINGS

The preferred embodiments will be described with reference to the drawings in which.

DETAILED DESCRIPTION OF PREFERRED EMBODIMENTS

Figure 1:
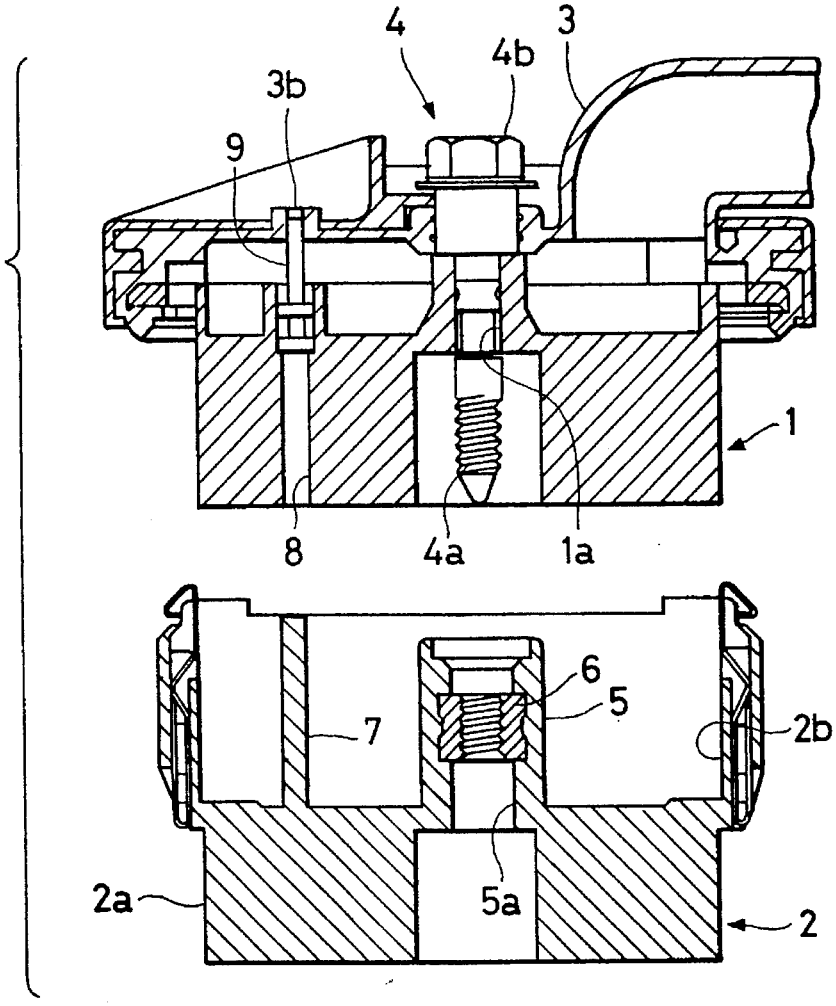
FIG. 1 is a vertical cross-sectional, front view of one embodiment of the present invention, showing a condition before two connector housings are fitted together.
Figure 2:
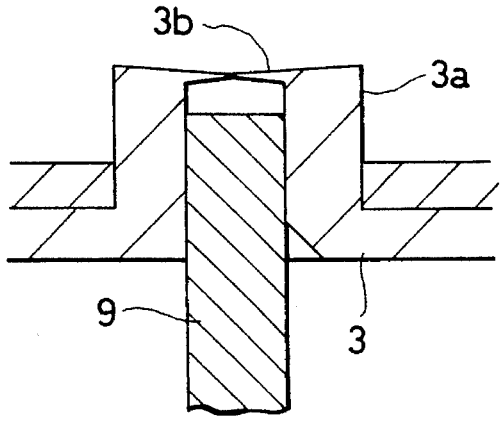
FIG. 2 is an enlarged, vertical cross-sectional, front view showing a distal end portion of a detection pin.
Figure 3:
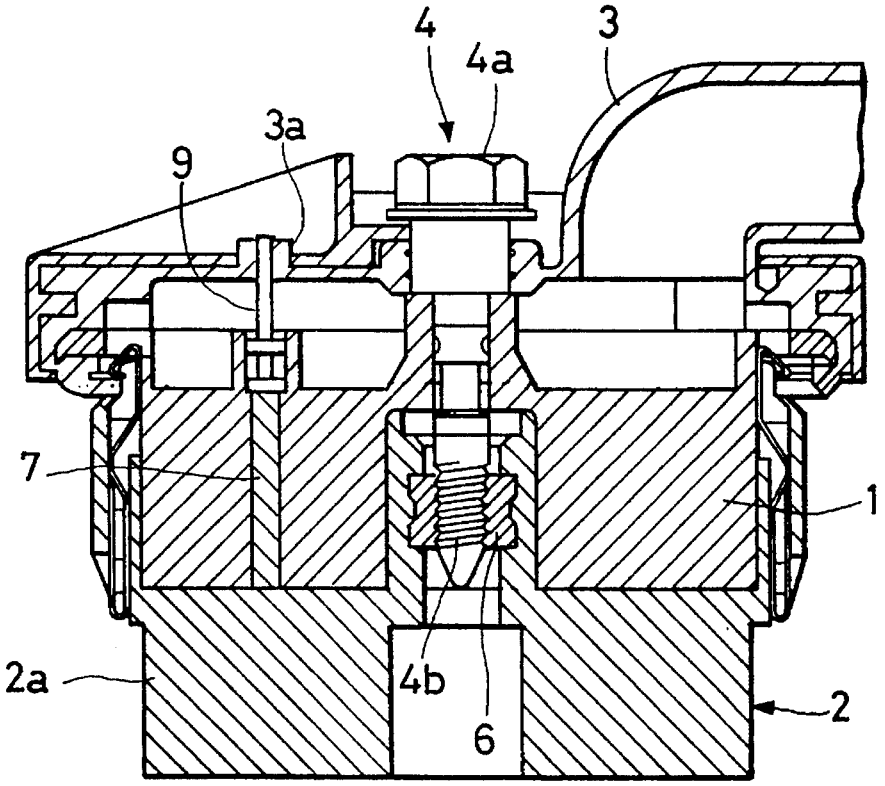
FIG. 3 is a vertical cross-sectional, front view showing a fitting-completed condition of the two connector housings.
Figure 4:
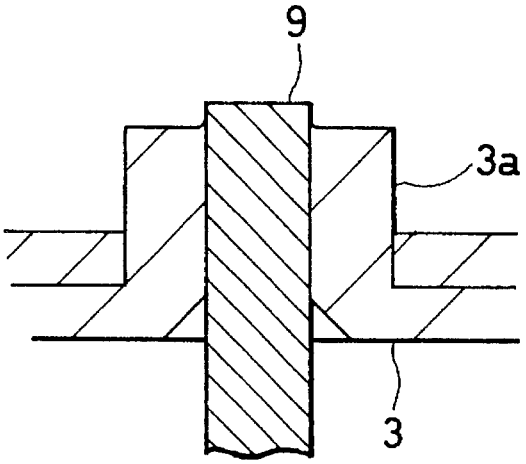
FIG. 4 is an enlarged, vertical cross-sectional, front view, showing the distal end portion of the detection pin in the fitting-completed condition.

A first embodiment will now be described with reference to the drawings. FIGS. 1 and 2 show a condition before two connector housings 1 and 2 are fitted together, and FIGS. 3 and 4 show a fitting-completed condition of the two connector housings 1 and 2.

A female connector housing 1 is in the form of a rectangular block as a whole and has a number of female terminals (not shown) provided therein. An upper surface portion of female connector housing 1 is covered with a cover 3 made, for example, of rubber.

A bolt insertion hole 1*a* is formed through a central portion of the female connector housing 1 in a vertical direction, and a bolt 4 is received in the bolt insertion hole 1*a*. A threaded portion 4*a* is formed only on a distal end portion of a shaft of the bolt 4, and a bolt head 4*b* is projected from the upper surface of the female connector housing 1. In this condition, the bolt 4 is rotatable relative to the female connector housing 1 and is supplied with a moving force in a direction (vertical direction in the drawings) of forward and backward threaded movement.

The male connector housing 2 has a tubular hood portion 2*b* of a square shape with an open top. The hood portion is formed on an upper portion of a base 2*a*, which is of a rectangular shape. The hood portion 2*b* has such a size that the female connector housing 1 can be fitted therein. A number of male terminals (not shown), corresponding respectively to the previously-mentioned female terminals, are provided within the male connector housing 2 and are supported on the base 2*a*.

A boss 5, having a through hole 5*a* vertically extending therethrough, is provided at a central portion of the male connector housing 2, and is projected upward from and formed integrally with the base 2*a*. A nut 6 for threaded engagement with the bolt 4 is provided integrally within the boss 5, for example, by insert molding. With this arrangement, by tightening the threaded portion 4*a* of the bolt 4 relative to the nut 6, the two connector housings 1 and 2 are displaced relative to each other in a connecting direction (vertical direction) and are fitted together, as shown in FIG. 3. In the fitted condition of the two connector housings 1 and 2, the male terminals are mechanically coupled respectively to the female terminals, and are electrically connected thereto.

A bar-like projection portion 7 is provided in the male connector housing 2 at a left portion thereof (in the drawings), and extends upward from the base 2*a*. This projection portion 7 extends generally to a level of an upper surface of the hood portion 2*b*. An insertion hole 8 corresponding to the projection portion 7 is formed through the female connector housing 1 and extends in the vertical direction. This insertion hole 8 has a stepped configuration such that its upper end portion is slightly larger in diameter than its lower portion. A detection pin 9, which is elongated in the vertical direction and functions as an indicator, is inserted into this upper end portion of a larger diameter from the upper side.

The lower end of the detection pin 9 is retained by a stepped portion of the insertion hole 8, so that its downward movement is limited. As shown in FIG. 2, this detection pin is inserted into a boss 3*a*, formed on the cover 3, from the lower side. An upper surface of the boss 3*a* is formed in a thin portion 3*b* that can be easily broken. Preferably, the detection pin 9 has a bright color different from that of the cover 3.

With this construction, when the two connector housings 1 and 2 are displaced relative to each other in a connecting direction, the projection portion 7 is inserted into the insertion hole 8, moves upward relative thereto, and finally urges the lower end of the detection pin 9 upward. Then, as shown in FIGS. 3 and 4, when the lower surface of the female connector housing 1 is mated with the upper surface of the base 2*a*, that is, the fitting of the two connector housings 1 and 2 is completed, the upper end of the detection pin 9 pierces the thin portion 3*b* of the cover 3, projecting from the upper surface and exposed to the exterior.

In the above construction, the two connector housings 1 and 2 are fitted together in the following manner. First, the female connector housing 1 is lightly fitted in the male connector housing from the upper side, so that the threaded portion 4a of bolt 4 can be threaded into nut 6. At this time, the upper end portion of the projection portion 7 is slightly inserted into the insertion hole 8.

Then, the operator tightens the bolt 4 relative to the nut 6, using a tool such as an impact wrench. As a result, the two connector housings 1 and 2 are displaced relative to each other in the connecting direction and are fitted together, as previously described. At this time, the projection portion 7 moves upward within the insertion hole 8 relative thereto and pushes the lower end of the detection pin 9 upwardly. Then, as shown in FIGS. 3 and 4, when the bolt 4 is tightened until the fitting of the two connector housings 1 and 2 is completed, the upper end portion of the detection pin 9 pierces the thin portion 3b of the cover 3, projecting upward from the upper surface and is exposed to the exterior.

The operator stops the tightening operation when he recognizes the detection pin 9 projecting from the upper surface. Therefore, the tightening operation can be completed in a suitable manner, that is, in the fitting-completed condition of the two connector housings 1 and 2, in which the bolt 4 is not excessively or insufficiently tightened. Thus, the detection pin 9 indicates the fitting-completed condition in accordance with the displacement of the two connector housings 1 and 2 in the connecting direction during the tightening of the bolt 4.

There is provided an excellent advantage in the invention that the two connector housings 1 and 2 can be positively brought into the fitting-completed condition. In this embodiment, the thin portion 3b is formed on the cover 3, and the detection pin 9 pierces this thin portion 3b to project from the upper surface. With this construction, when the detection pin 9 is not projected upward before the completion of fitting of the connector, the detection pin 9 is not seen even if viewed from above the connector. When the detection pin 9 is projected upward upon completion of the fitting of the connector, this pin can be viewed for the first time. Therefore, an incorrect confirmation of the detection pin 9 can be prevented.

In the above embodiment, the detection pin 9 is urged and displaced by the projection portion 7 to pierce the thin portion 3b of the cover 3; however, the shape of the indicator, as well as the structure for displacing the indicator, can be modified, and the invention is not meant to be limited. For example, a viewing window may be provided on the connector housing so that the displacement of the indicator can be displayed, or the indicator may be swingingly displaced to indicate the fitting-completed condition.

Further, the present invention can be suitably modified without departing from the scope thereof. For example, the bolt may be provided on the male connector housing while the nut is provided on the female connector housing. There can additionally be used a construction in which the threaded portion of the bolt can extend forward from the nut to freely rotate in the fitting-completed condition of the two connector housings.

A connector of the invention according to a second embodiment is shown in FIGS. 5–10 and includes a female connector housing 1 in the form of a rectangular block as a whole and has a number of female terminals (not shown) provided therein. A cover 3 made, for example, of rubber is attached to an upper surface of the female connector housing 1 by a cover holder 3a.

A bolt insertion hole 1a is formed through a central portion of the female connector housing 1 in a vertical direction, and a bolt 4 is received in the bolt insertion hole 1a. A threaded portion 4a is formed only on a distal end portion of a shaft of the bolt 4, and a bolt head 4b is projected from the upper surface of the female connector housing 1. In this condition, the bolt 4 is rotatable relative to the female connector housing 1 and is supplied with a moving force in a direction (vertical direction in the drawings) by forward and backward threaded movement.

Figure 5:
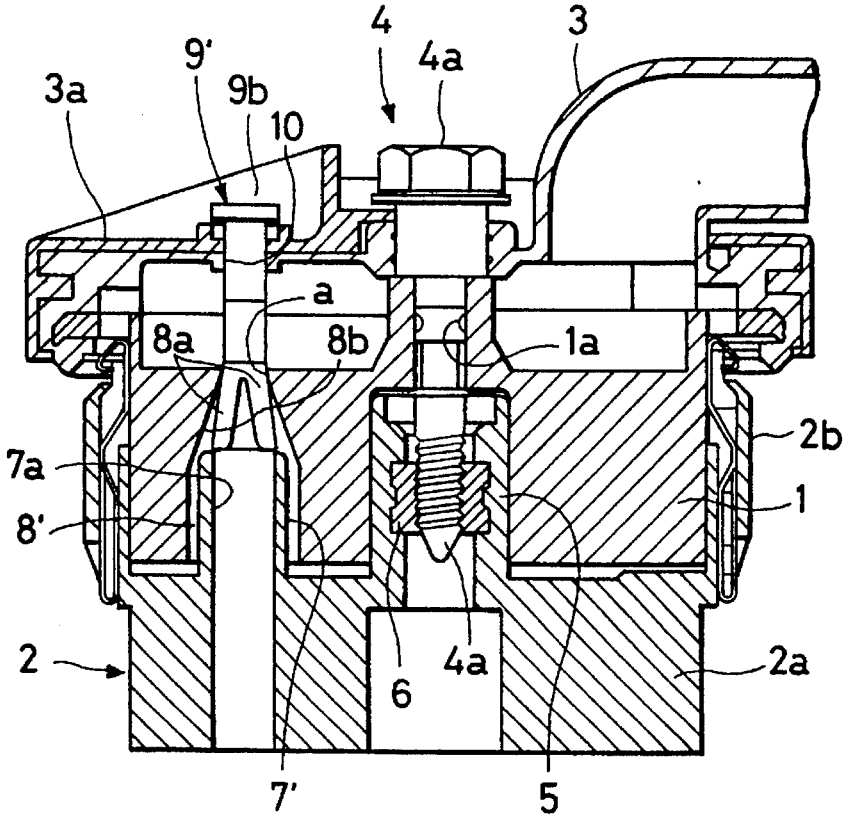
FIG. 5 is a vertical cross-sectional, front view of a second embodiment of the present invention, showing a fitting-uncompleted condition of two connector housings.
Figure 7:
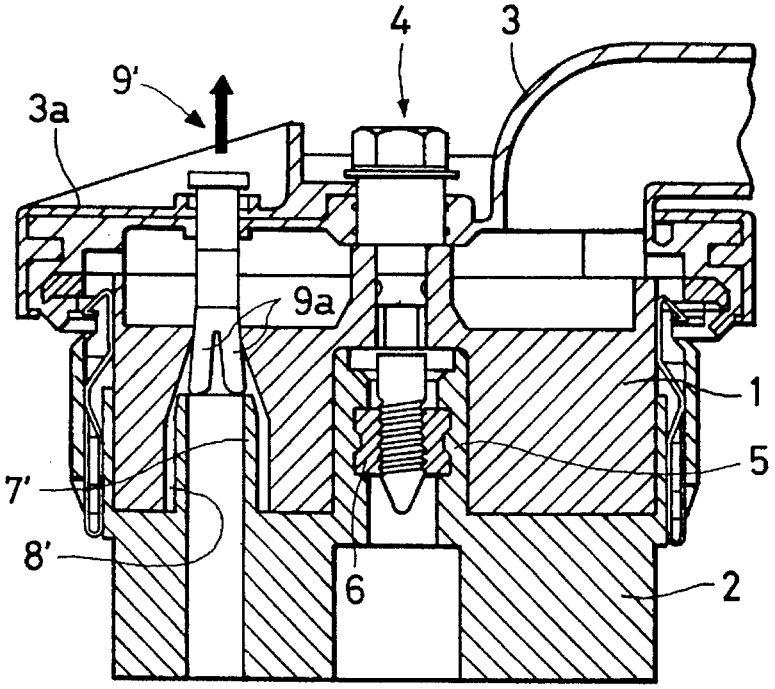
FIG. 7 is a vertical cross-sectional, front view showing a condition immediately before the fitting of the two connector housings is completed.
Figure 8:
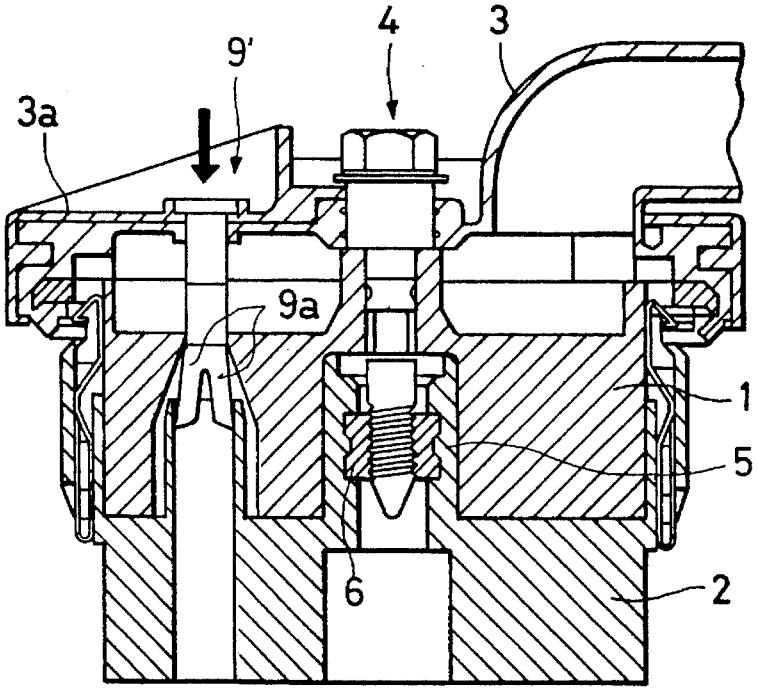
FIG. 8 is a vertical cross-sectional, front view showing a fitting-completed condition of the two connector housings.

As shown in FIGS. 5, 7 and 8, the male connector housing 2 has a tubular hood portion 2b of a square shape with an open top, which hood portion is formed on an upper portion of a base 2a of a rectangular shape. The hood portion 2b has such a size that the female connector housing 1 can be fitted therein. A number of male terminals (not shown), corresponding respectively to the previously-mentioned female terminals, are provided within the male connector housing 2 and are supported on the base 2a.

A boss 5 is provided at a central portion of the male connector housing 2, and is projected upwardly from and formed integrally with the base 2a. A nut 6 for threaded engagement with the bolt 4 is provided integrally within the boss 5, for example, by insert molding. With this arrangement, by tightening the threaded portion 4a of the bolt 4 relative to the nut 6, the two connector housings 1 and 2 are displaced relative to each other in a connecting direction (upward-downward direction) and are fitted together. In the fitted condition of the two connector housings 1 and 2, the male terminals are coupled respectively to the female terminals and are electrically connected thereto.

Figure 9:
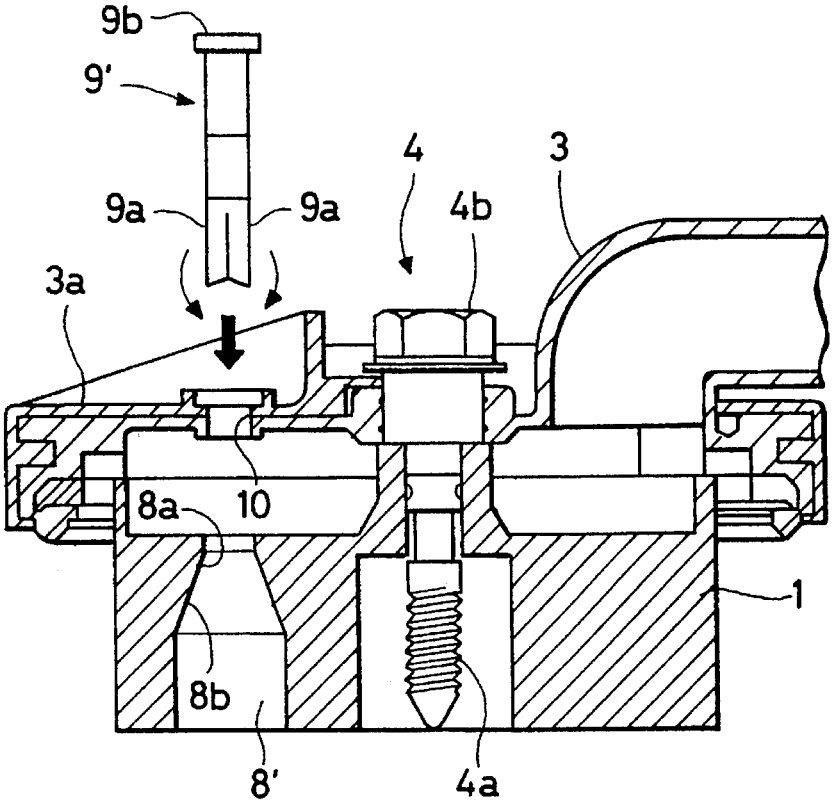
FIG. 9 is a vertical cross-sectional, front view showing a condition before the fitting detection pin is attached to the female connector housing.
Figure 10:
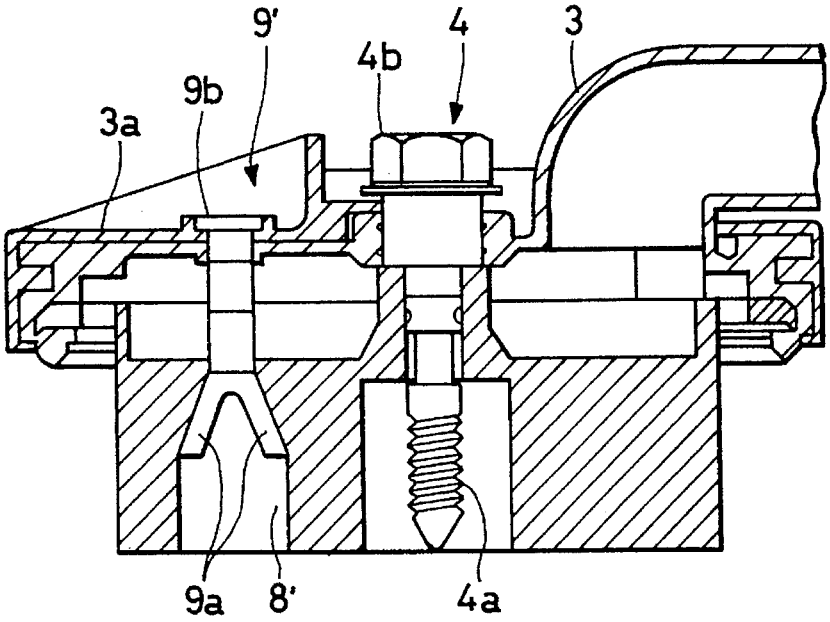
FIG. 10 is a vertical cross-sectional, front view showing a condition in which the fitting detection pin is attached to the female connector housing.

A pin insertion hole 8' for the insertion of a fitting detection pin 9' (later described) thereinto is formed in a left portion (in the drawings) of the female connector housing 1 and extends therethrough in a vertical direction. As shown in FIG. 9, the pin insertion hole 8' has a smaller-diameter portion 8a at its upper end portion, a tapered portion 8b, which extends from this smaller-diameter portion to an intermediate portion and increases in diameter progressively downwardly. A lower half portion of a larger diameter extends to a lower end of the hole without changing its diameter. An insertion port 10 is formed in the cover 3 and the cover holder 3a and is disposed in registry with the upper end portion of the pin insertion hole 8'. On the other hand, as shown in FIG. 5, the male connector housing 2 has a projection portion 7' in the form of a cylindrical boss that is projected upwardly from the base 2a, and is disposed in registry with the pin insertion hole 8'. An insertion hole 7a is formed through the projection portion 7' in a vertical direction.

The fitting detection pin 9' is made, for example, of a plastics material and has integral insertion pieces 9a and 9a provided at a distal end portion of a shaft thereof corresponding in diameter to the smaller-diameter portion 8a of the pin insertion hole 8' and the insertion port 10, the insertion pieces 9a and 9a being expansible into a bifurcated configuration in a downward direction. A head 9b of an enlarged diameter is formed on the upper end of the fitting detection pin 9'. The insertion pieces 9a and 9a are expanded outwardly away from each other when an external force acts on them, and the insertion pieces can be resiliently deformed inwardly, that is, in a direction to narrow the expansion, by an external force.

The fitting detection pin 9' is beforehand received at its distal end portion in the pin insertion hole 8' of the female connector housing. In this case, for setting the fitting detection pin 9' on the female connector housing 1, the insertion pieces 9a and 9a are joined together into a smaller dimension as shown in FIG. 9, and in this condition, the fitting detection pin is inserted into the pin insertion hole 8' through the insertion port 10. As a result, the insertion pieces 9a and 9a are expanded into an angle corresponding to that of the tapered portion 8b of the pin insertion hole 8', with the head 9b placed on the upper surface of the insertion port 10.

Next, the operation for fitting the two connector housings 1 and 2 together in the above construction will now be described. First, the female connector housing 1, having the fitting detection pin 9' beforehand attached thereto as described above, is lightly fitted into the male connector housing 2 from the upper side, so that the threaded portion 4a of the bolt 4 can now be threaded into the nut 6.

Then, the operator tightens the bolt 4 relative to the nut 6 using a tool such as an impact wrench. As a result, the two connector housings 1 and 2 are displaced relative to each other in a connecting direction and are fitted together as described above. At this time, the projection portion 7' is inserted into the pin insertion hole 8' from the lower side and moves upward as the two connector housings 1 and 2 are displaced in the connecting direction. Then, the two connector housings 1 and 2 are fitted together to a certain degree, and in this half-fitted condition, the distal end (that portion around the insertion hole 7a) of the projection portion 7' retains the insertion pieces 9a and 9a to urge the fitting detection pin 9' upwardly as shown in FIGS. 5 and 6, so that the fitting detection pin 9' is pushed back upwardly.

Figure 6:
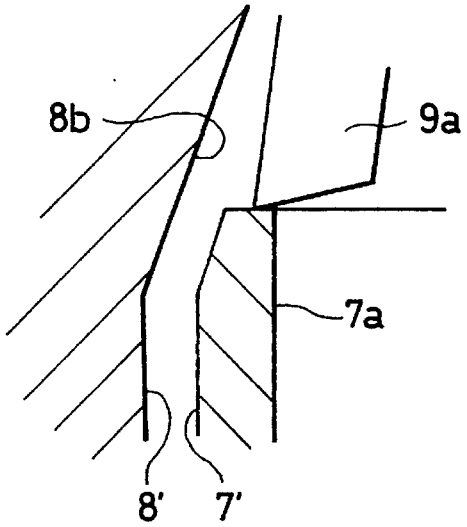
FIG. 6 is an enlarged view showing a distal end portion of a fitting detection pin.

When this fitting detection pin 9' is pushed back upwardly, the insertion pieces 9a and 9a move upward within the pin insertion hole 8', and are deformed inwardly by the smaller-diameter portion 8a at the upper portion of the insertion hole, so that the expansion of the insertion pieces is reduced (see FIG. 6). Thus, as the fitting of the two connector housings 1 and 2 proceeds, the expansion of the insertion pieces 9a and 9a is reduced, and in a fitting-uncompleted condition before a condition (see FIG. 7) immediately before the fitting-completed condition, the width between the insertion pieces 9a and 9a is still larger than the inner diameter of the insertion hole 7a of the projection portion 7'. Therefore, in the fitting-uncompleted condition of the two connector housings 1 and 2, the distal end portion of the fitting detection pin 9' is retained by the distal end of the projection portion 7', and is prevented from further insertion.

Then, when the two connector housings 1 and 2 are finally fitted together completely, the amount of deformation of the insertion pieces 9a and 9a is large, and the retaining of the insertion pieces 9a and 9a relative to the projection portion 7' is released. The width between the insertion pieces 9a and 9a is reduced to such a dimension that they can be inserted into the insertion hole 7a. Therefore, in this condition, the fitting detection pin 9' can be inserted to a position beyond the distal end of the projection portion 7', and by pushing the fitting detection pin 9', the distal end portion of the fitting detection pin 9' is inserted into the insertion hole 7a, as shown in FIG. 8. Therefore, by realizing how far the fitting detection pin 9' can be inserted, the operator can know whether or not the two connector housings 1 and 2 are in the fitting-completed condition.

In this embodiment, depending on whether or not the two connector housings 1 and 2 are in the fitting-completed condition, the amount of insertion of the fitting detection pin 9' is varied. Therefore, by inserting the fitting detection pin 9' into the pin insertion hole 8' at the time of fitting the two connector housings 1 and 2 together, the operator can readily know the condition of fitting of the two connector housings 1 and 2. As a result, an excessive tightening of the bolt 4 can be prevented, and also the situation in which the operation is stopped when the two connector housings 1 and 2 are still in the half-fitted condition is prevented. This provides an excellent advantage that the two connector housings 1 and 2 can be positively brought into the fitting-completed condition. Furthermore, the fitting detection pin 9' will not be projected if the connector is not fitted, and therefore, when the connectors are transferred as single units, the fitting detection pin is prevented from dropping.

Figure 11:
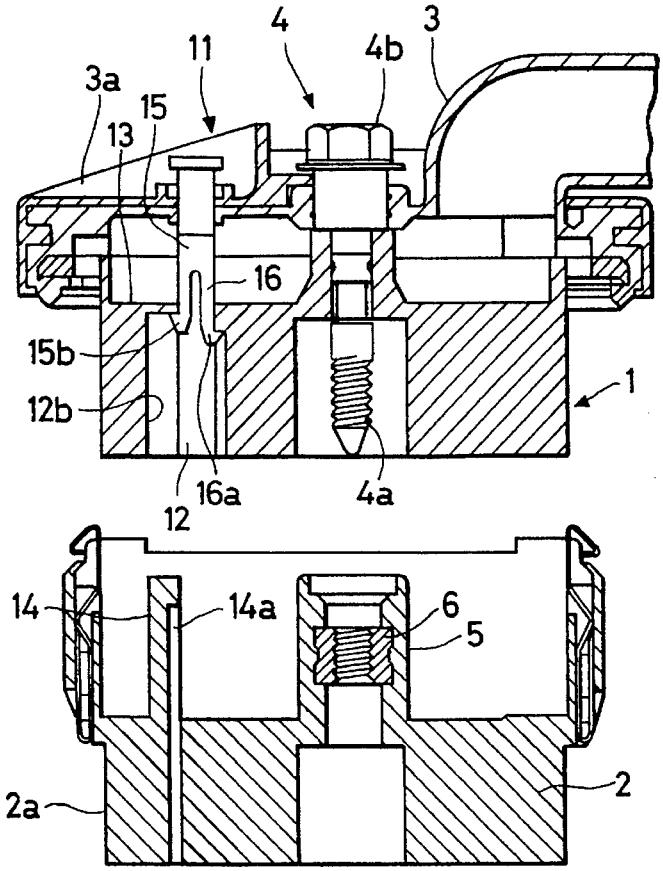
FIG. 11 is a vertical cross-sectional, front view of a third embodiment of the present invention, showing a condition before two connector housings are fitted together.
Figure 12:
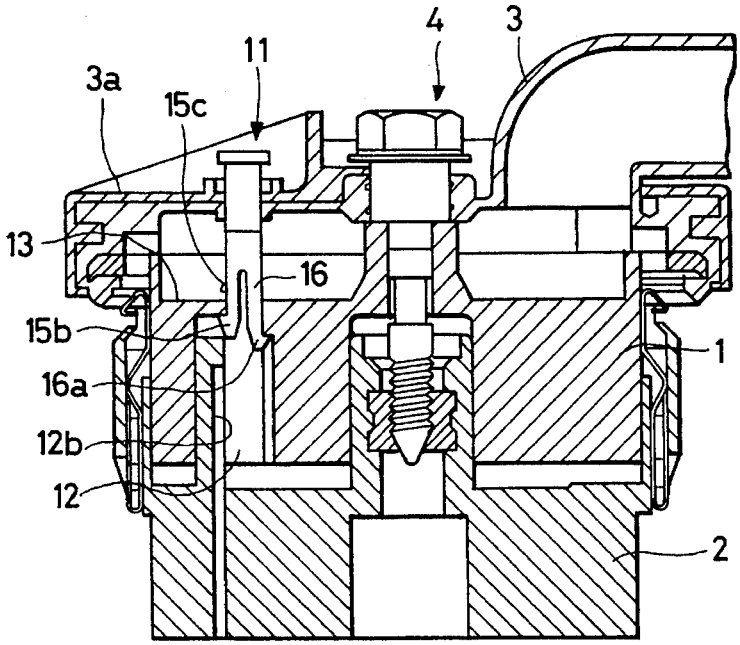
FIG. 12 is a vertical cross-sectional, front view showing a fitting-completed condition.
Figure 13:
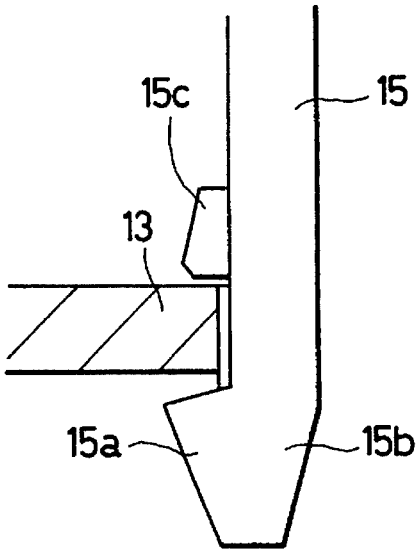
FIG. 13 is a cross-sectional view showing a distal end portion of a fitting detection pin on an enlarged scale.
Figure 14:
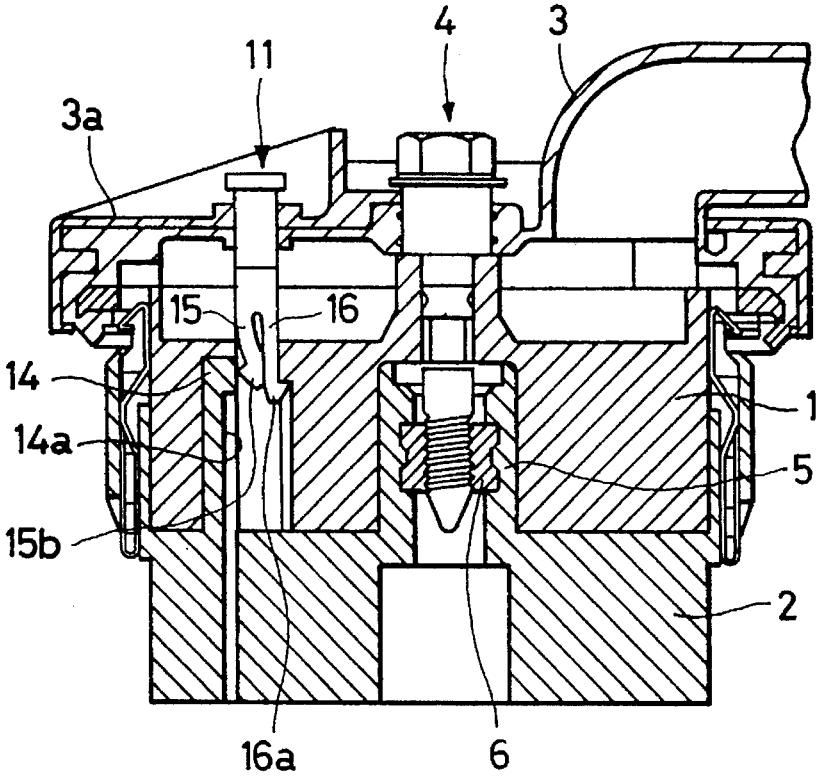
FIG. 14 is a vertical cross-sectional, front view showing the fitting process.
Figure 15:
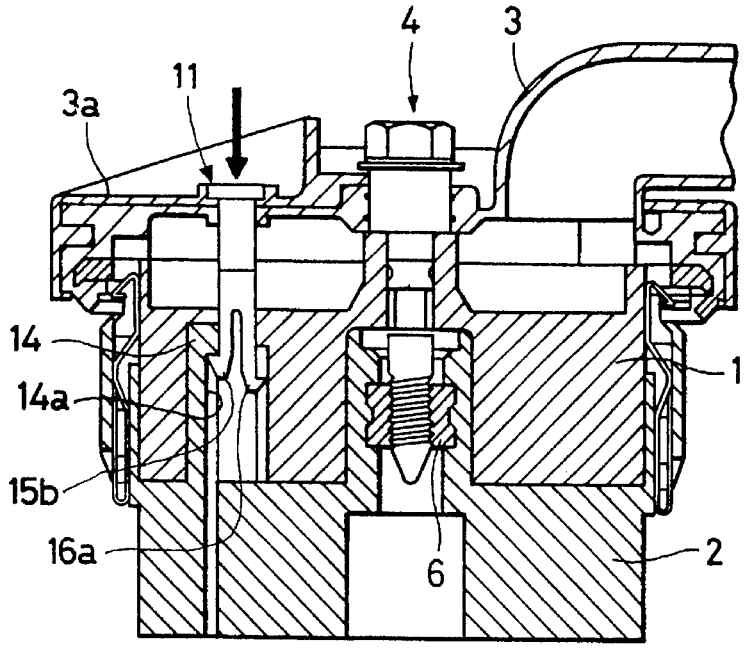
FIG. 15 is a vertical cross-sectional, front view showing a fitting-completed condition.

A third embodiment of the present invention will now be described with reference to FIGS. 11 to 16. FIG. 11 shows a condition before two connector housings 1 and 2 are fitted together, FIG. 12 shows a fitting-uncompleted condition (half-fitted condition), FIG. 14 shows a condition immediately before the completion of the fitting, and FIG. 15 shows a fitting-completed condition.

Figure 16:
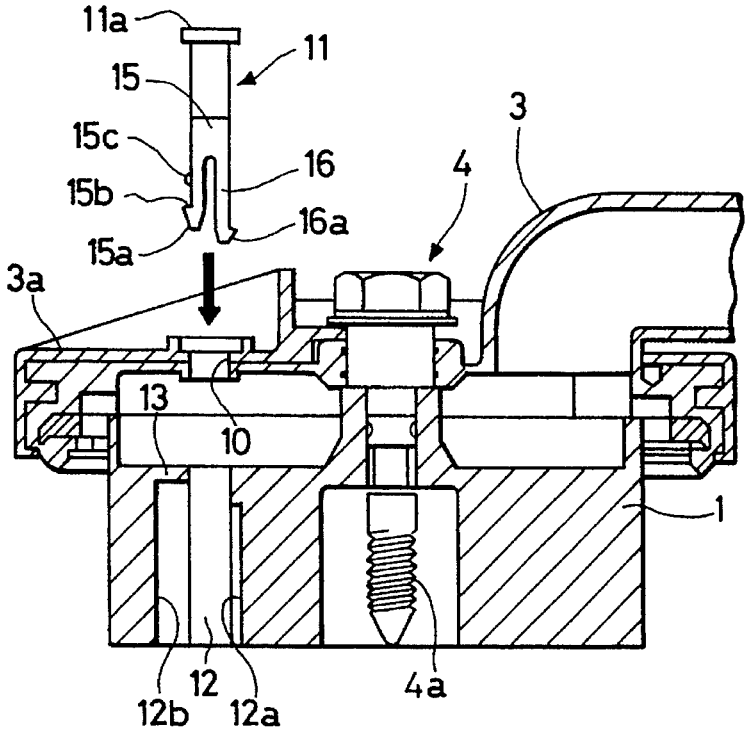
FIG. 16 is a vertical cross-sectional, front view showing a condition before the fitting detection pin is attached.

In this embodiment, as shown in FIG. 16 and other figures, a pin insertion hole 12 for the insertion of a fitting detection pin 11 (later described) thereinto is formed in a left portion (in the drawings) of the female connector housing 1 and extends therethrough in an upward-downward direction. A shallow groove 12a is formed in a right portion (in the drawings) of the pin insertion hole 12 and extends downwardly except for an upper end portion thereof. A deep groove 12b deeper than the shallow groove 12a is formed in a left portion (in the drawings) of the pin insertion hole 12 and extends downwardly except for the upper end portion. With this arrangement, a retaining wall portion 13 is formed at the upper end of the deep groove 12b of the female connector housing 1, as shown in FIG. 13 and other figures. The male connector housing 2 has a projection portion 14 corresponding to the deep groove 12b of the pin insertion hole 12, which projection portion is projected upwardly from a base 2a, as shown in FIG. 11 and other figures. A groove 14a is formed in a right portion (in the drawings) of the projection portion 14 and extends downwardly except for an upper end portion thereof.

The fitting detection pin 11 is made, for example, of a plastics material and has a head 11a of an enlarged diameter at an upper end of its shaft and integral bifurcated insertion pieces 15 and 16 at a distal end portion of its shaft, which insertion pieces extend substantially downwardly, as shown in FIG. 16. As shown in FIG. 13, a pawl 15b having a slanting surface 15a is formed at the distal end of the left insertion piece 15 and is directed outwardly (to the left), and further an outwardly convex portion 15c is formed on this insertion piece and is disposed slightly above pawl 15b. A pawl 16a is formed on the distal end of the right insertion piece 16 and is directed outwardly (to the right in the drawngs). The insertion pieces 15 and 16 can be resiliently deformed inwardly.

The fitting detection pin 11 is attached to the female connector housing 1 in such a manner that the pin is inserted into the pin insertion hole 12. In this condition, the pawl 16a of the right insertion piece 16 is engaged in the shallow groove 12a of the pin insertion hole 12, and the retaining wall portion 13 is disposed between the pawl 15b and the convex portion 15c of the left insertion piece 15 so that the fitting detection pin 11 is prevented from movement in both upward and downward directions.

In this embodiment, when the two connector housings 1 and 2 are displaced in a connecting direction, the projection portion 14 is inserted into the deep groove 12b of the pin insertion hole 12 from the lower side and is moved upwardly relative thereto. Then, as shown in FIGS. 12 and 13, when the two connector housings 1 and 2 are fitted together to a certain degree, that is, in a half-fitted condition, the distal end of the projection portion 14 abuts against the slanting surface 15*a* of the pawl 15*b* on the distal end of the insertion piece 15 and urges it upwardly so that the insertion piece 15 held against upward and downward movement is displaced inwardly (to the right). Then, when the two connector housings 1 and 2 are finally brought into the fitting-completed condition, the amount of deformation of the insertion piece 15 becomes maximum, so that the pawl 15*b* is displaced right from the projection portion 14, and the convex portion 15*c* is disposed on the right side of the retaining wall portion 13.

Therefore, in this condition, the fitting detection pin 11 can be inserted into the pin insertion hole 12, and by pushing the fitting detection pin 11, the fitting detection pin 11 is fully inserted into the pin insertion hole 12 as shown in FIG. 15. At this time, the pawl 15*b* of the insertion piece 15 becomes engaged in the groove 14*a* of the projection portion 14.

Thus, in this third embodiment, also, by realizing how far the fitting detection pin 11 can be inserted, the operator can know whether or not the two connector housings 1 and 2 are in the fitting-completed condition, as in the above embodiments. As a result, an excessive tightening of bolt 4 can be prevented, and also the situation in which the operation is stopped when the two connector housings 1 and 2 are still in the half-fitted condition is prevented. Therefore, there is provided an excellent advantage that the two connector housings 1 and 2 can be positively brought into the fitting-completed condition.

In each of the above embodiments, in the fitting operation of the two connector housings 1 and 2, whether or not the fitting-completed condition is achieved is detected by the fitting detection pin 9, 9', 11; however, whether or not the fitting-completed condition is achieved may be checked by inserting the fitting detection pin 9, 9', 11 after the fitting operation. The insertion hole and the fitting detection pin may be provided at the male connector housing 2 while the projection portion may be provided at the female connector housing 1.

In the connector of the present invention, as described above, the pin insertion hole for the insertion of the fitting detection pin thereinto is provided in the one connector housing, and the retaining projection portion is provided on the other connector housing, and the amount of insertion of the fitting detection pin is varied depending on whether or not the two connector housings are in the fitting-completed condition. With this construction, there is achieved an excellent advantage that by inserting the fitting detection pin into the pin insertion hole, the condition of fitting of the two connector housings can be readily perceived.

Figure 17:
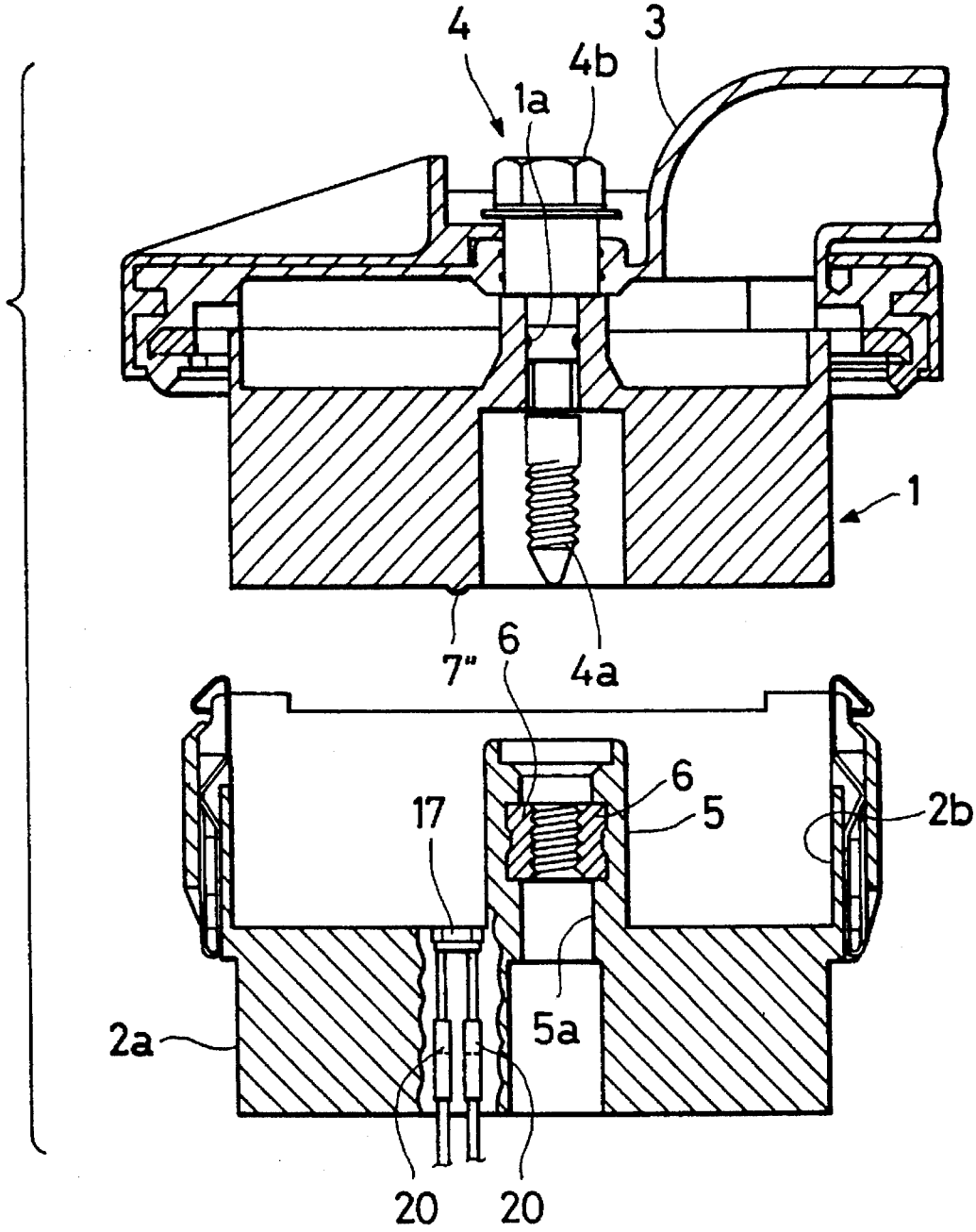
FIG. 17 is a vertical cross-sectional, front view of a fourth embodiment of the present invention, showing a condition before the completion of the fitting of two connector housings.
Figure 18:
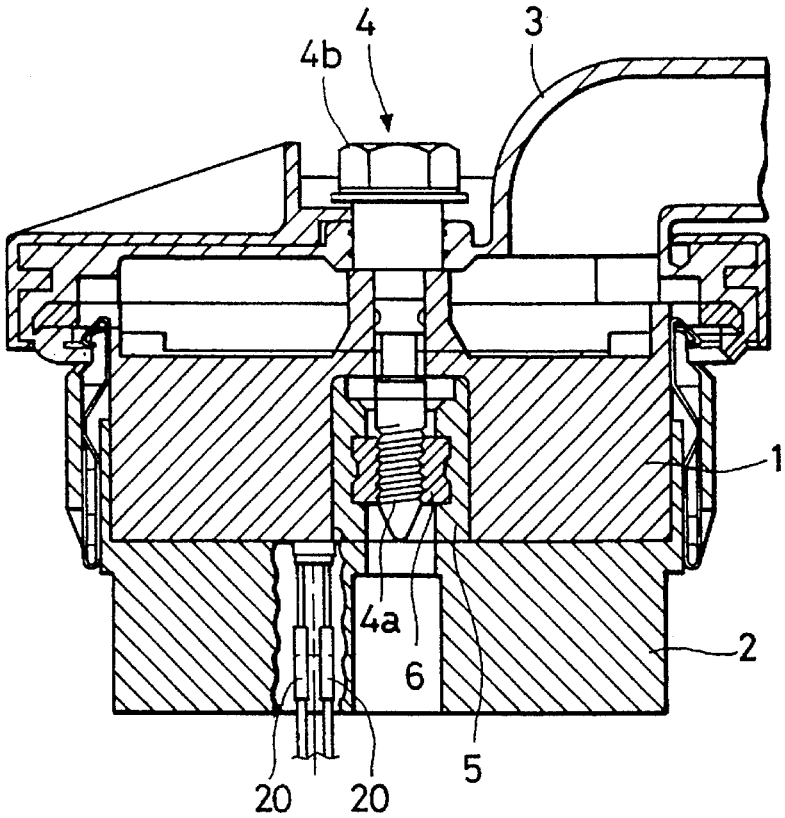
FIG. 18 is a vertical cross-sectional, front view showing a fitting-completed condition of the two connector housings.

A fourth embodiment in which the present invention is applied to a so-called screw tightening-type connector will now be described with reference to FIGS. 17 to 19. As shown in FIGS. 17 and 18, the female connector housing 1 is in the form of a rectangular block as a whole and has a number of female terminals (not shown) provided therein. An upper surface portion of female connector housing 1 is covered with a cover 3 made, for example, of rubber.

A bolt insertion hole 1*a* is formed through a central portion of the female connector housing 1 in a vertical direction, and a bolt 4 is received in the bolt insertion hole 1*a*. A threaded portion 4*a* is formed only on a distal end portion of a shaft of the bolt 4, and a bolt head 4*b* is projected from the upper surface of the female connector housing 1. In this condition, the bolt 4 is rotatable relative to the female connector housing 1 and is supplied with a moving force in a direction of forward and backward threaded movement.

The male connector housing 2 has a tubular hood portion 2*b* of a square shape with an open top. The hood portion is formed on an upper portion of a rectangular-shaped base 2*a*. The hood portion 2*b* has a size such that the female connector housing 1 can be fitted therein. A number of male terminals (not shown), corresponding respectively to the above-mentioned female terminals, are provided within the male connector housing 2 and supported on the base 2*a*.

A boss 5, having a through hole 5*a* vertically extending therethrough, is provided at a central portion of the male connector housing 2 and is projected upwardly from and formed integrally with the base 2*a*. A nut 6 for threaded engagement with the bolt 4 is provided integrally within the boss 5, for example, by insert molding.

Figure 19:
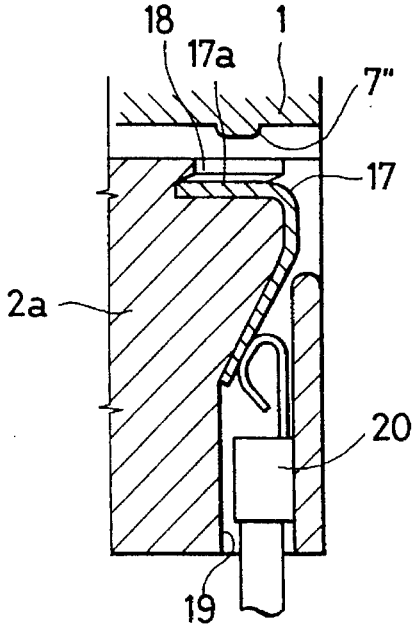
FIG. 19 is an enlarged, vertical cross-sectional, side view of a portion of a connector housing.

A projection 7" serving as a pressing portion is formed integrally on a portion of a lower surface of the female connector housing 1 slightly offset to the left of center, as best shown in FIG. 19. A pressure-sensitive element 17 is provided at a portion of the upper surface of the base 2*a* of the male connector housing 2 slightly offset to the left of center, that is, immediately adjacent to the left side of the boss 5. In this embodiment, the pressure-sensitive element 17 comprises a pressure-sensitive, electrically-conductive rubber that varies in resistance upon application of pressure.

As shown in FIG. 19, a mounting recess 18 is formed in the upper surface of the base 2*a*, and a hole 19 continuous with the mounting recess 18 extends downwardly and is open to the lower surface of the male connector housing 2. The pressure sensitive element 17 has a generally hook-shape as viewed from a side thereof, and a pressure detection surface 17*a* at an upper end portion thereof is disposed in the mounting recess 18. Within the hole 19, a pair of fitting detection connection terminals 20 and 20 are connected at their upper ends to electrodes of the pressure-sensitive element 17. The terminals 20 and 20 output a signal from the pressure-sensitive element 17.

With this arrangement, when the fitting of the two connector housings 1 and 2 is not completed as shown in FIGS. 17 and 19, no pressure acts on the pressure sensitive element 17. This renders a high resistance value for the pressure sensitive element 17. On the other hand, as shown in FIG. 18, when the lower surface of the female connector housing 1 is mated with the upper surface of the base 2*a* in the fitted-completed condition, the projection 7 is received in the mounting recess 18 to press the pressure detection surface 17*a* of the pressure sensitive element 17. By this pressing, the electrical resistance of the pressure sensitive element 17 is decreased.

In the above construction, the two connector housings 1 and 2 are fitted together in the following manner. First, the female connector housing 1 is lightly fitted in the male connector housing 2 from the upper side, so that the threaded portion 4*a* of the bolt 4 can be threaded into the nut 6. Also, a detection circuit (not shown) is beforehand connected to the fitting detection connection terminals 20 and 20. Any one of various kinds of detection circuits can be used as such circuits are well known in the art. For example, a simple circuit may include a general-purpose meter, a power source such as a battery, and a lamp or a buzzer serially connected together. In short, any type may be used in so far as it can detect a change in the electrical resistance of the pressure sensitive element 17 and can indicate the change to the operator.

The operator tightens the bolt 4 relative to the nut 6, using a tool such as an impact wrench. As a result, the two connector housings 1 and 2 are displaced relative to each other in the connecting direction to be fitted together, as described above. At this time, when the bolt 4 is tightened until the fitting of the two connector housings 1 and 2 is completed, the pressure sensitive element 17 is pressed by the projection 7", so that the electrical resistance of element 17 decreases. The detection circuit detects the pressing of the pressure sensitive element 17.

In accordance with the detection by the detection circuit, the operator stops the tightening operation. Therefore, the tightening of the bolt 4 can be stopped in a suitable condition in which the fitting of the two connector housings 1 and 2 is completed without excessive or insufficient tightening of the bolt 4.

Thus, in the present invention, in the fitting-completed condition of the two connector housings 1 and 2, the projection 7" formed on the female connector housing 1 presses the pressure sensitive element 17 provided on the male connector housing 2. By detecting the output of the pressure sensitive element 17 by the detection circuit, the fitting-completed condition of the two connector housings 1 and 2 can be detected.

A fifth embodiment of the present invention will now be described with reference to FIGS. 20 and 21. In this embodiment, the present invention is applied to a screw tightening-type connector as in the previous embodiments.

A metal piece 21 for electrical connection purposes is provided on a lower surface of a female connector housing 1, while a pair of conductors 22 and 22 are provided at an upper portion of a base 2*a* of a male connector housing 2. Fitting detection connection terminals 23 and 23 for determining whether or not electrical connection between the conductors 22 and 22 is established are provided within a hole in the base 2*a* and are connected to the conductors 22 and 22, respectively.

Figure 20:
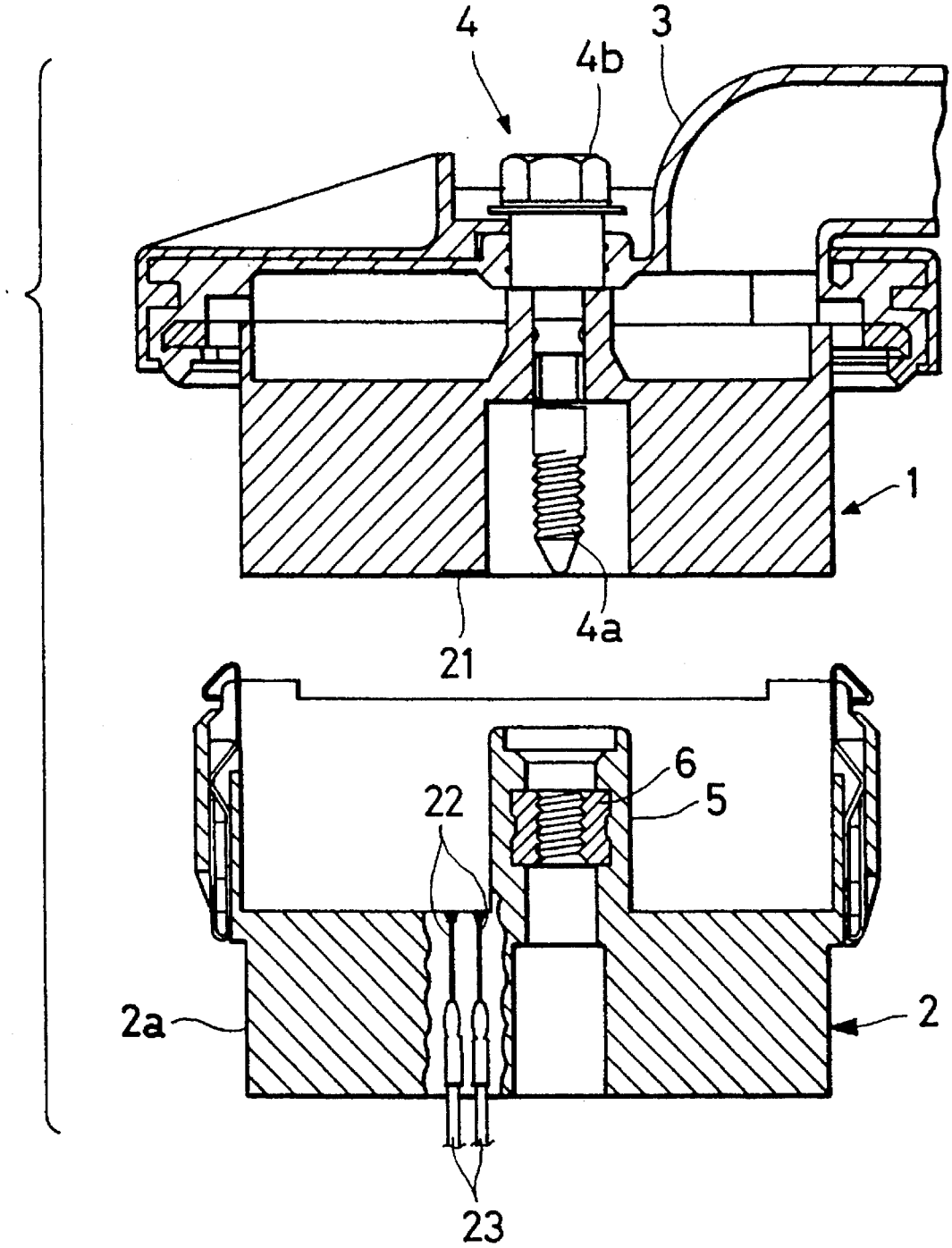
FIG. 20 is a view similar to FIG. 17, showing a fifth embodiment of the present invention.
Figure 21:
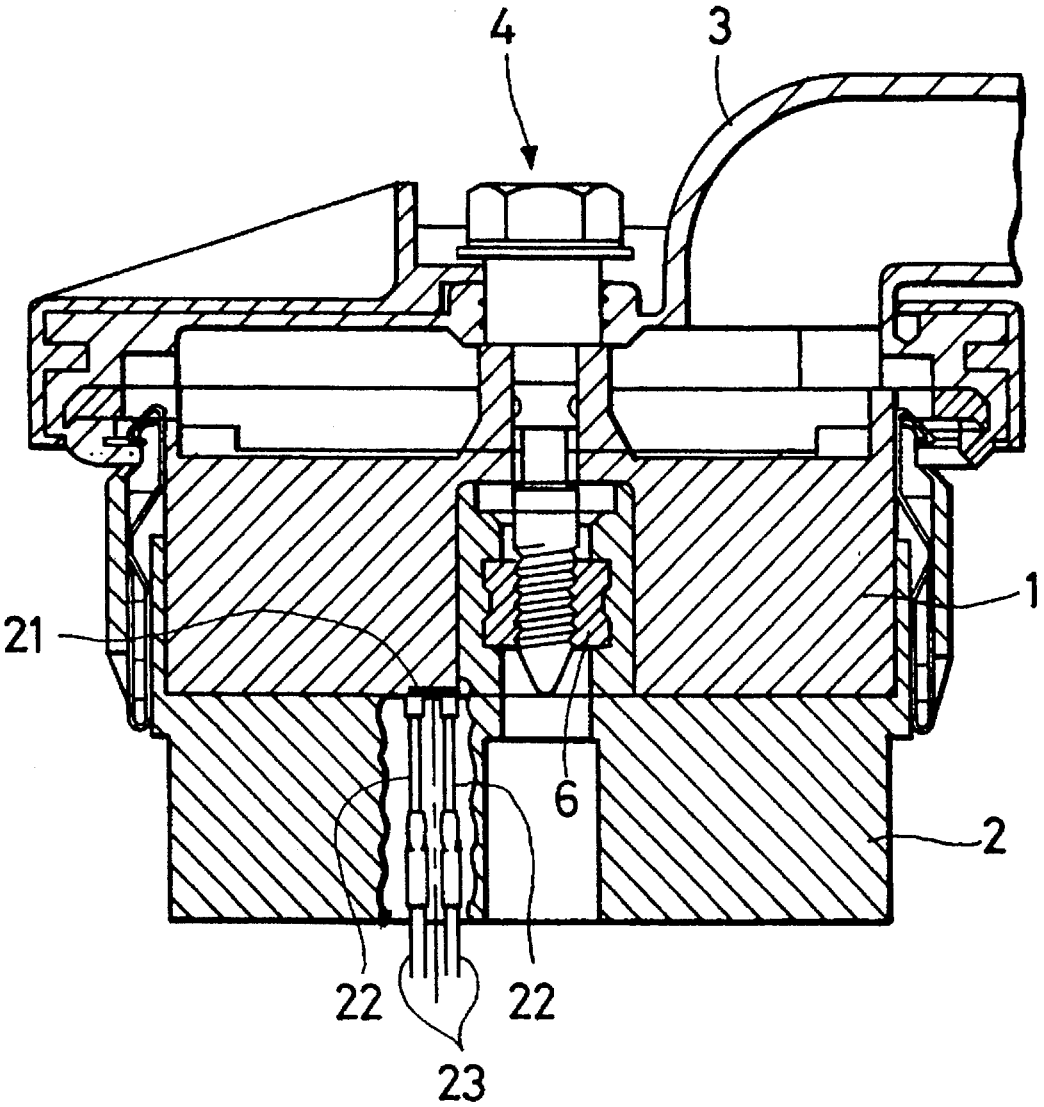
FIG. 21 is a view similar to FIG. 18.

With this arrangement, when the fitting of the two connector housings 1 and 2 is not completed as shown in FIG. 20, electrical connection between the two conductors 22 and 22 is not established. When the fitting of the two connector housings 1 and 2 is completed as shown in FIG. 21, the connecting metal piece 21 interconnects and is contacted with the two conductors 22 and 22, so that electrical connection between the conductors 22 and 22 is achieved.

Therefore, by connecting a detection circuit (not shown) to the fitting detection connection terminals 23 and 23 as in the previous embodiment, a fitting-completed condition can be readily detected. As a result, the stopping of the fitting operation in a half-fitted condition of the two connector housings 1 and 2 is prevented, and there is provided an excellent advantage that the two connector housings 1 and 2 can be positively brought into the fitting-completed condition.

In this second embodiment, although the pair of conductors 22 and 22 are provided in the male connector housing 2 and can be electrically connected together by the connecting metal piece 21 provided on the female connector housing 1, a conductor and a fitting detection connection terminal may be provided on each of the two connector housings. In this case, the conductors provided respectively on the two connector housings can be contacted with each other in the fitting-completed condition.

In each of the above embodiments, the fitting-completed condition can be detected during the fitting of the two connector housings 1 and 2 or after the fitting operation. The pressure sensitive element 17 and the conductors 22 may be provided on the female connector housing 1.

In this embodiment, the pair of conductors which are electrically connected together in the fitting-completed condition are provided on the connector housing. Therefore, there is achieved an excellent advantage that by detecting whether or not electrical connection between the two conductors is established, the condition of the fitting of the two connector housings can be readily perceived.

While the invention has been described With reference to preferred embodiment, these embodiments are not intended to be limiting. Various modifications can be made without departing from the scope of the appended claims.

What is claimed is:

1. A connector wherein a first connector housing and a second connector housing are displaced relative to each other in a connecting direction so that said first and second connector housings can be fitted together, the connector further comprising:

a pin insertion aperture formed in said first connector housing and having opposite open ends;

a fitting detection pin having a resiliently inwardly-deformable insertion piece at a distal end thereof, said detection pin being inserted into said pin insertion aperture from one end of said pin insertion aperture; and a projection portion formed on said second connector housing, said projection portion being inserted into said pin insertion aperture from the other end thereof in accordance with the displacement of said first and second connector housings in the connecting direction, said projection pin retaining said fitting detection pin at a distal end thereof to urge said detection pin toward the one end of said pin insertion aperture, wherein when said fitting detection pin is urged by said projection portion, said insertion piece is gradually resiliently deformed inwardly, in a fitting-uncompleted condition of said first and second connector housings, said fitting detection pin is retained from further insertion by said projection portion, and in a fitting-completed condition of said two connector housings, the amount of deformation of the insertion piece is large, so that the retaining thereof by said projection portion is released, and therefore said fitting detection pin can be inserted within the distal end of said projection portion.

2. The connector of claim 1, wherein said pin insertion aperture includes a first vertically extending groove and an opposing second vertically extending groove, said second extending groove terminating at a retaining wall portion extending inward into said pin insertion aperture.

3. The connector of claim 2, wherein said detection pin includes two inwardly deformable pawls, one being engageable within said first groove and guidable therealong and the other pawl being engageable within said second groove and guidable therealong.

4. The connector of claim 3, wherein said detection pin additionally includes a third pawl located above said retaining wall, said detection pin being restrained from movement within said pin insertion hole by said third pawl being on one side of said retaining wall and said first pawl being located on an opposite side of said retaining wall.

5. The connector of claim 3, wherein said projection portion comprises an inclined surface for inwardly deforming said first pawl in a fitting-completed condition, thereby allowing said detection pin to freely move within said pin insertion aperture.

6. A connector including a first connector housing and a second connector housing displaced relative to each other in a connecting direction so that said first and second connector housings can be fitted together, the connector further comprising:

a pin insertion aperture formed in said first connector housing and having opposite open ends;

a fitting detection pin which has a resiliently inwardly-deformable insertion piece at a distal end thereof, said detection pin extending into said pin insertion aperture from one end of said pin insertion aperture, said inwardly-deformable insertion piece being disposed entirely within said pin insertion aperture; and a projection portion formed on said second connector housing, said projection portion extending into said pin insertion aperture from the other end of said aperture when said first and second connector housings are fitted together.

7. The connector of claim 6, wherein said projection portion urges said fitting detection pin toward the one end of said pin insertion aperture in a fitting-uncompleted condition of said first and second housings, said insertion piece being gradually resiliently deformed inwardly as said housings are mated together, said insertion piece being deformed to a size in a fitting-complete condition that allows said detection pin to be movable within said pin insertion aperture toward said other end, thereby indicating said fitting-completed condition.

* * * * *